US005349968A

United States Patent [19]

Rizzoli et al.

[11] Patent Number: 5,349,968

[45] Date of Patent: Sep. 27, 1994

[54] METHOD OF PRODUCING FILTER-TIPPED CIGARETTES

[75] Inventors: Salvatore Rizzoli, Bologna; Fiorenzo Draghetti, Medicina, both of Italy

[73] Assignee: G.D Societa' per Azioni, Bologna, Italy

[21] Appl. No.: 95,071

[22] Filed: Jul. 20, 1993

[30] Foreign Application Priority Data

Jul. 22, 1992 [IT] Italy ..... BO92A 000282
May 31, 1993 [IT] Italy ..... BO93A 000246

[51] Int. Cl.[5] ..... A24C 5/47; A24C 5/52

[52] U.S. Cl. ..... 131/94; 131/282; 198/448

[58] Field of Search ..... 131/282, 94, 84.1; 198/448, 602, 951

[56] References Cited

U.S. PATENT DOCUMENTS

| | | | |
|---|---|---|---|
| 2,929,489 | 3/1960 | Parrish | 131/282 X |
| 3,215,250 | 11/1965 | Schubert et al. | 198/33 |
| 3,229,802 | 1/1966 | Molins et al. | 131/282 X |
| 3,245,514 | 4/1966 | Herrmann | 131/282 X |
| 3,303,926 | 2/1967 | Pohl | 198/211 |
| 3,363,632 | 1/1968 | Gamberini | 131/94 |
| 3,483,873 | 12/1969 | Hinzmann | 131/94 X |
| 3,527,234 | 9/1970 | Hinzmann | 131/94 |
| 3,565,237 | 2/1971 | Strydom | 131/282 X |
| 3,625,103 | 12/1971 | Giatti | 131/94 |
| 3,633,735 | 1/1972 | Molins et al. | 198/448 X |
| 3,961,633 | 6/1976 | Schubert et al. | 131/94 |
| 4,519,406 | 5/1985 | Mattei | 131/94 |
| 4,531,629 | 7/1985 | Seragnoli et al. | 198/458 |
| 5,135,008 | 8/1992 | Oesterling et al. | 131/94 |

FOREIGN PATENT DOCUMENTS

| | | | |
|---|---|---|---|
| 2349812A | 10/1973 | Fed. Rep. of Germany . | |
| 2072686 | 9/1971 | France . | |
| 2584579A1 | 1/1987 | France . | |
| 2154534 | 9/1985 | United Kingdom | 131/282 |
| 2241866A | 9/1991 | United Kingdom . | |

*Primary Examiner*—Jennifer Bahr
*Attorney, Agent, or Firm*—Marshall, O'Toole, Gerstein, Murray & Borun

[57] ABSTRACT

An orderly succession of first tobacco items, each including of a double cigarette portion, is fed along a path, along which the first items are cut into two portions, which are connected by rolling, and by means of an outer band and the interposition of an intermediate double filter, to form an orderly succession of second items, which are cut to form a first and second succession of third items consisting of single, side by side, oppositely-oriented cigarettes; the cigarettes in one of the two successions being turned over 180° in relation to those in the other succession to form at least one stream of equioriented cigarettes for supply to a follow-up machine; and the pitch of the various successions of items undergoing only one change along the entire path.

18 Claims, 5 Drawing Sheets

METHOD OF PRODUCING FILTER-TIPPED CIGARETTES

BACKGROUND OF THE INVENTION

The present invention relates to a method of producing filter-tipped cigarettes.

As described, for example, in British Patent N. 2,241,866, filter-tipped cigarettes are known to be produced on a filter assembly machine defining, internally, a path along which elongated tobacco items are fed transversely in relation to their axis. The input of the above known filter assembly machine is supplied with a succession of first tobacco items consisting of double cigarette portions, which, as they are fed transversely along said path and through a cutting station, are each cut into two single portions forming a first and second orderly succession side by side and parallel to each other. Inside a rolling station, each portion in one of the two successions is connected to a corresponding portion in the other, to form a second tobacco item hereinafter referred to as a "double cigarette." Each double cigarette consists of two cigarette portions separated by a double filter made integral with the two cigarette portions by a band, the central portion of which encloses the double filter, and each end portion of which encloses one end of a respective cigarette portion.

Still with reference to the above British patent, once formed, the double cigarettes are fed successively through a cutting station where they are cut transversely in half to form two successions of third tobacco items consisting of oppositely-oriented single cigarettes. That is, downstream from the cutting station, the cigarettes in each pair produced by cutting a respective double cigarette are arranged with their filters facing and substantially contacting each other.

According to the above British patent, the two successions of filter-tipped cigarettes are then fed to a turnover station where the cigarettes in one succession are turned over those in the other and into the gaps between respective adjacent pairs of cigarettes in said other succession, so as to produce a single succession of equioriented cigarettes, which are fed to the output of the filter assembly machine and directly or indirectly to the input of a packing machine.

Alternatively, as described in Italian Patent Application N. BO92A 000311, inside the turnover station, the cigarettes in one succession are turned over away from those in the other, so as to produce two separate successions of equioriented cigarettes, which are then fed to respective outputs of the filter assembly machine.

According to U.S. Pat. No. 5,135,008, the pitch or center distance between the tobacco items traveling along said path through the filter assembly machine undergoes only two successive reductions, following each of which the items are fed forward closer together. In actual fact, the items undergo three pitch reductions, one of which, however, is an inevitable consequence of the rolling operation, and is annulled when the original pitch is restored immediately after rolling.

On modern filter assembly machines, on which the tobacco items are fed transversely at relatively high speed, reductions in the pitch of the items involve not only relatively complex, high-cost handling operations, but also variations in speed resulting in relatively marked inertial forces capable of damaging the items.

SUMMARY OF THE INVENTION

It is an object of the present invention to provide a method of producing filter-tipped cigarettes, designed to minimize the aforementioned drawback.

More specifically, it is an object of the present invention to provide a method designed to minimize the operations required for so arranging the cigarettes as to correctly supply at least one bulk feed channel of a packing machine.

According to the present invention, there is provided a method of producing filter-tipped cigarettes, the method comprising a stage consisting in feeding an orderly succession of first tobacco items along a given path; each first item comprising two cigarette portions and an intermediate double filter; and said feeding stage in turn comprising stages consisting in connecting, along said path, the two cigarette portions and the intermediate double filter by means of a rolling stage and an outer band, to form an orderly succession of second items; successively feeding the second items to a cutting station located along said path, to form a first and second succession of third items consisting of single, side by side, oppositely-oriented filter-tipped cigarettes; and, along said path, turning the cigarettes in one of the two successions over by 180° in relation to those in the other succession, to form at least one stream of equioriented cigarettes for supply to a follow-up machine; characterized by the fact that said successions of said tobacco items traveling along said path undergo only one change in pitch along the entire path.

According to a preferred embodiment of the above method, said one change in pitch is imparted to said second items.

Said one change in pitch is preferably imparted to said second items in the course of said rolling stage.

In particular, each said second item is preferably fed, in the course of said rolling stage, along a rolling channel; said one change in pitch being imparted to each said second item along said rolling channel.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
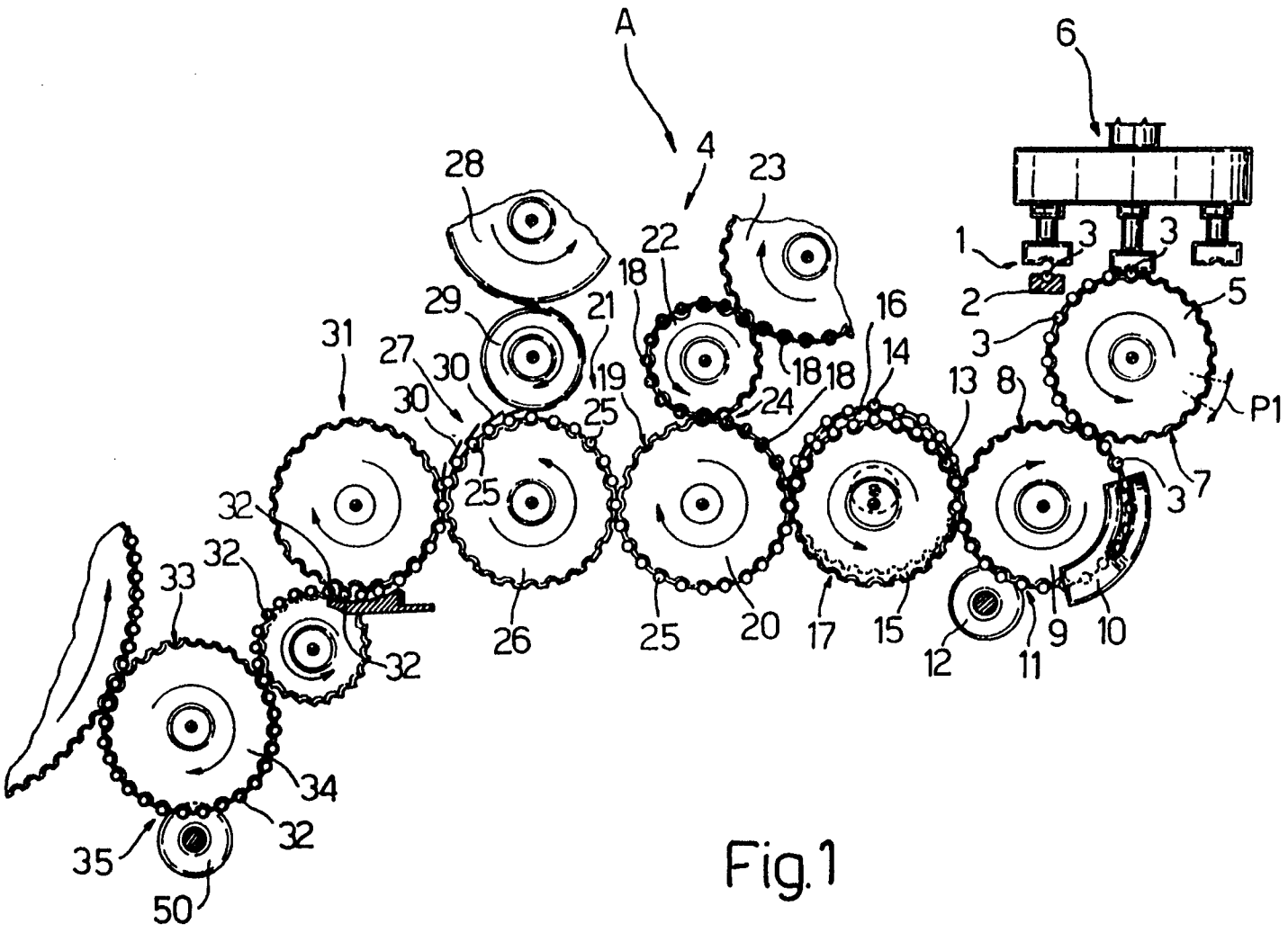
FIG. 1 shows a schematic view in perspective of a first portion of a system implementing the method according to the present invention.
Figure 2:
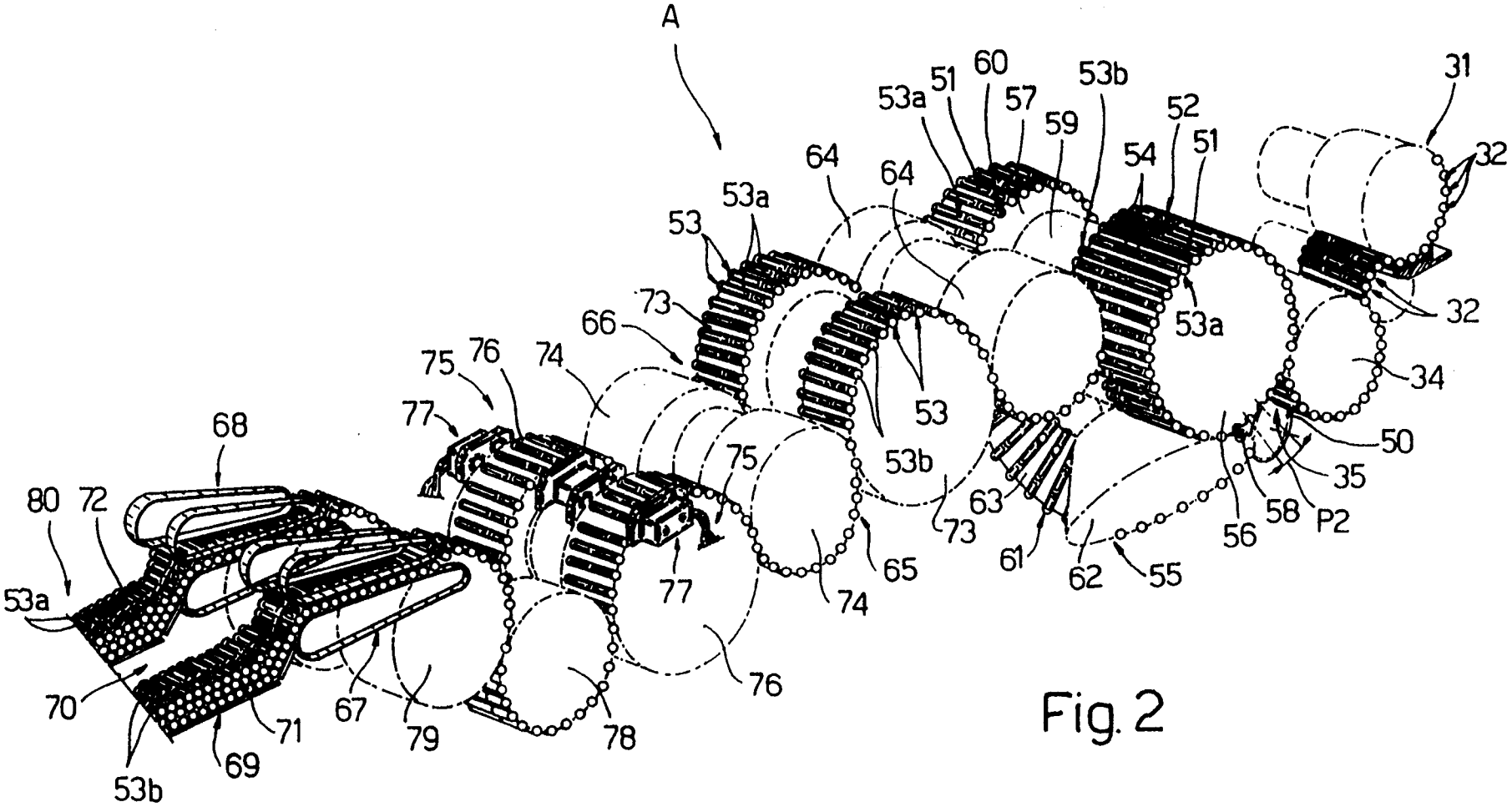
FIG. 2 shows a schematic view in perspective of a second portion of the FIG. 1 system.
Figure 5:
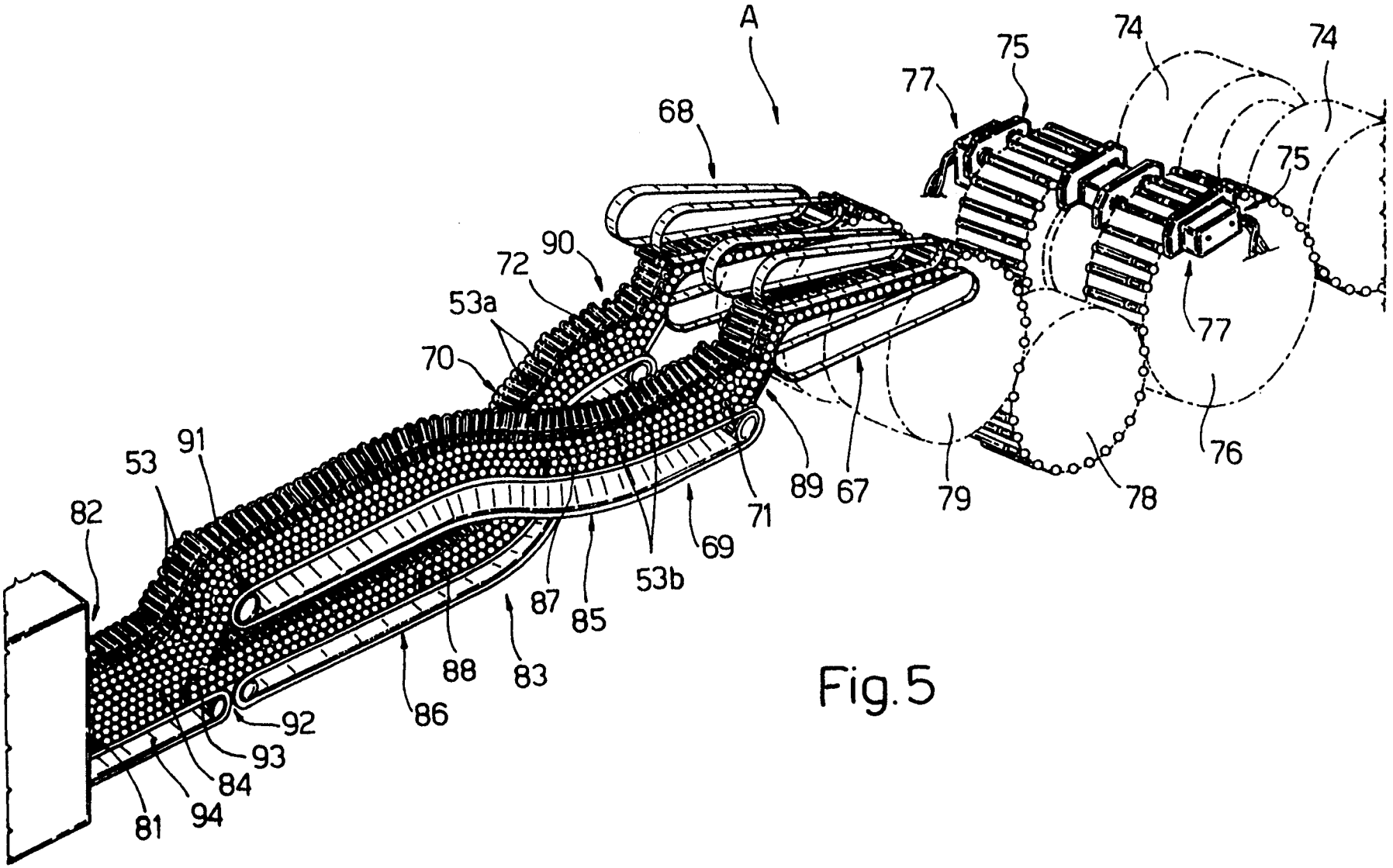
FIG. 5 shows a variation of a detail in the FIG. 2 system.

"A" in FIGS. 1, 2 and 5 Indicates a system for producing filter-tipped cigarettes. As shown in FIG. 1, system A comprises a known cigarette manufacturing machine 1 in turn comprising an output plate 2 along which a continuous cigarette rod (not shown) is fed at substantially constant axial speed, and is cut, by means of a known cutting head (not shown), into a succession of cigarette portions 3.

Said cutting head (not shown) is rotated in known manner at such a speed as to produce portions 3 of a length equal to the total length of the tobacco-filled portions of two filter-tipped cigarettes being produced.

Number 4 in FIG. 1 indicates a filter assembly machine, the input roller 5 of which is connected to output plate 2 of machine 1 by a rotary transfer unit 6, e.g. of the type described in U.S. Pat. No. 3,303,926 to which full reference is made herein in the interest of full disclosure. As it rotates about its axis, unit 6 provides, in known manner, for successively transferring portions 3 from output plate 2 into respective seats 7 equally spaced by distance P1 about the periphery of input roller 5, which is powered so as to rotate counterclockwise in FIG. 1 and at constant angular speed about its axis parallel to plate 2.

Figure 3:
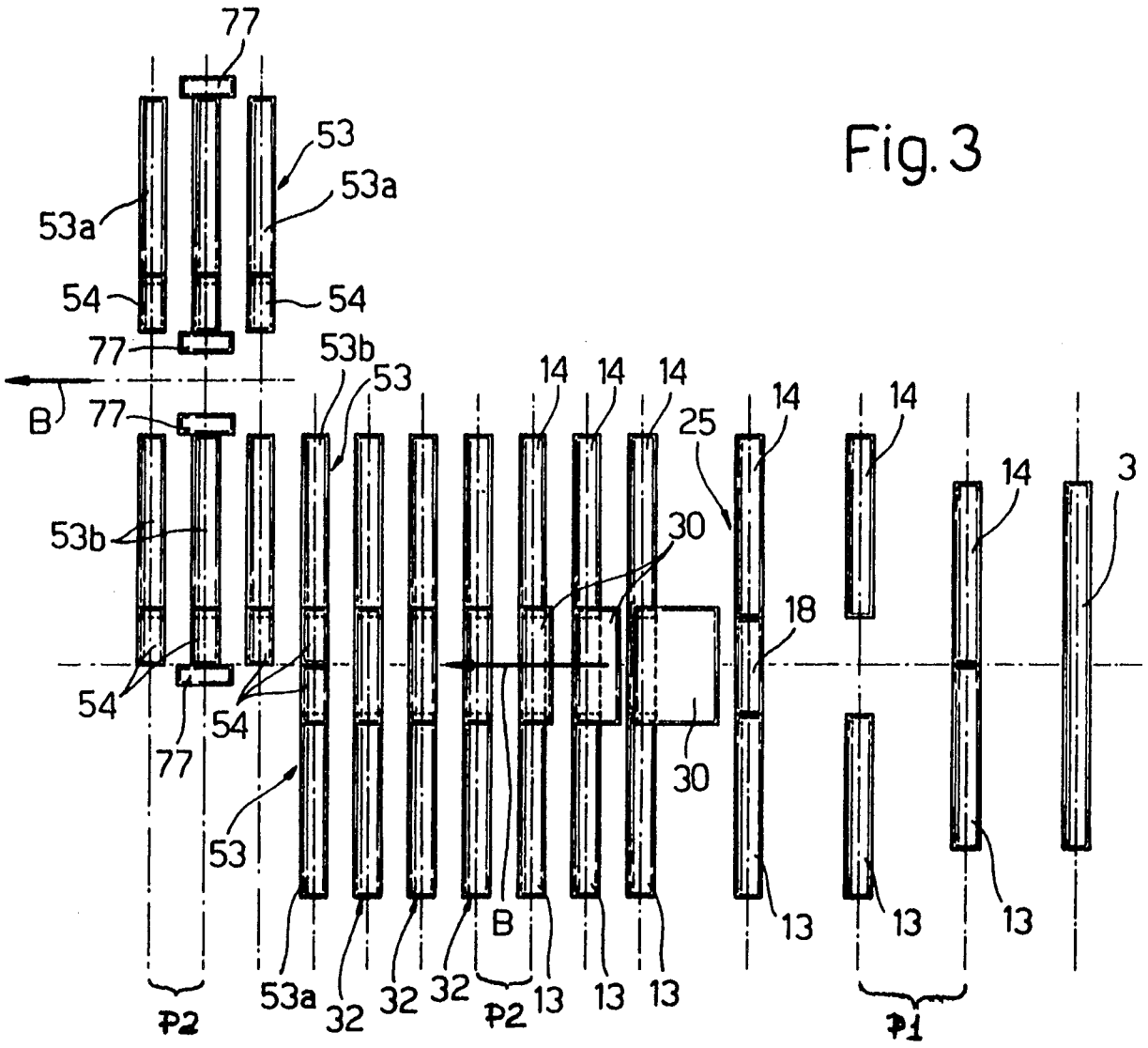
FIG. 3 shows a schematic view of the successive stages in the method according to the present invention.

As it rotates about its axis, roller 5 provides for feeding portions 3 transversely along an initial portion of path B (FIG. 3) extending along the whole of machine 4. Roller 5 provides for transferring portions 3 successively into respective seats 8 equally spaced by said distance P1 about the periphery of a roller 9 powered so as to rotate clockwise in FIG. 1. Roller 9 is located tangent to roller 5, and provides for feeding portions 3 along a circular path forming part of path B, and along which the ends of portions 3 are brought into contact with an aligning plate 10 for perfectly aligning portions 3 transversely.

Once aligned, portions 3 are fed by roller 9, still along path B, through a cutting station 11 where a blade 12 cuts each portion 3 into two portions 13 and 14, which remain aligned inside seat 8 with their ends substantially contacting each other.

Roller 9 is located tangent to the side by side rollers 15 and 16 of an axial parting or spacing unit indicated as a whole by 17 and of the type described in U.S. Pat. No. 4,531,629 to which full reference is made herein in the interest of full disclosure. By means of unit 17, the rollers 15 and 16 of which are offset vertically, portions 13 and 14 aligned inside each seat 8 are parted axially by a distance substantially equal to the length of a double filter 18, and are fed into seats 19 equally spaced by said distance P1 about the periphery of a roller 20 substantially tangent to rollers 15 and 16 and rotating about its axis in the same direction as roller 9 and at the same surface speed as rollers 15 and 16.

Roller 20 is located parallel to roller 9, and forms part of a known assembly unit 21 located along path B and also comprising a first and second feed roller 22, 23 for supplying double filters 18. Roller 22 is located between and substantially tangent to rollers 20 and 23, rotates about its axis in the opposite direction to and at the same surface speed as rollers 20 and 23, and provides for feeding each double filter 18 into a respective seat 19 at a loading station 24 upstream from the point of tangency between roller and rollers 15 and 16. More specifically, roller 22 feeds each double filter 18 into a substantially central portion of respective seat 19 corresponding to the gap between the facing ends of a respective pair of portions 13 and 14. Once fed into respective seat 19, each double filter 18 thus defines, inside seat 19, two vacant end portions, which are subsequently filled by respective coaxial portions 13 and 14 to form, on roller 20, a group 25 consisting of two portions 13 and 14 separated by a double filter 18.

Groups 25 are fed successively by roller 20 to the input roller 26 of a finishing unit 27 also located along path B and comprising first and second cascade rollers 28, 29 for supplying roller 26 with a succession of bands 30 for joining portions 13 and 14 and double filter 18 of respective groups 25. Unit 27 also comprises a rolling unit 31 for successively receiving groups 25 and bands 30; rolling each band 30 about a respective double filter 18 and the end portions of respective portions 13 and 14 facing double filter 18, to form a double cigarette 32; and feeding double cigarettes 32 into respective seats 33 on roller 34 of a cutting unit 35.

Figure 4:
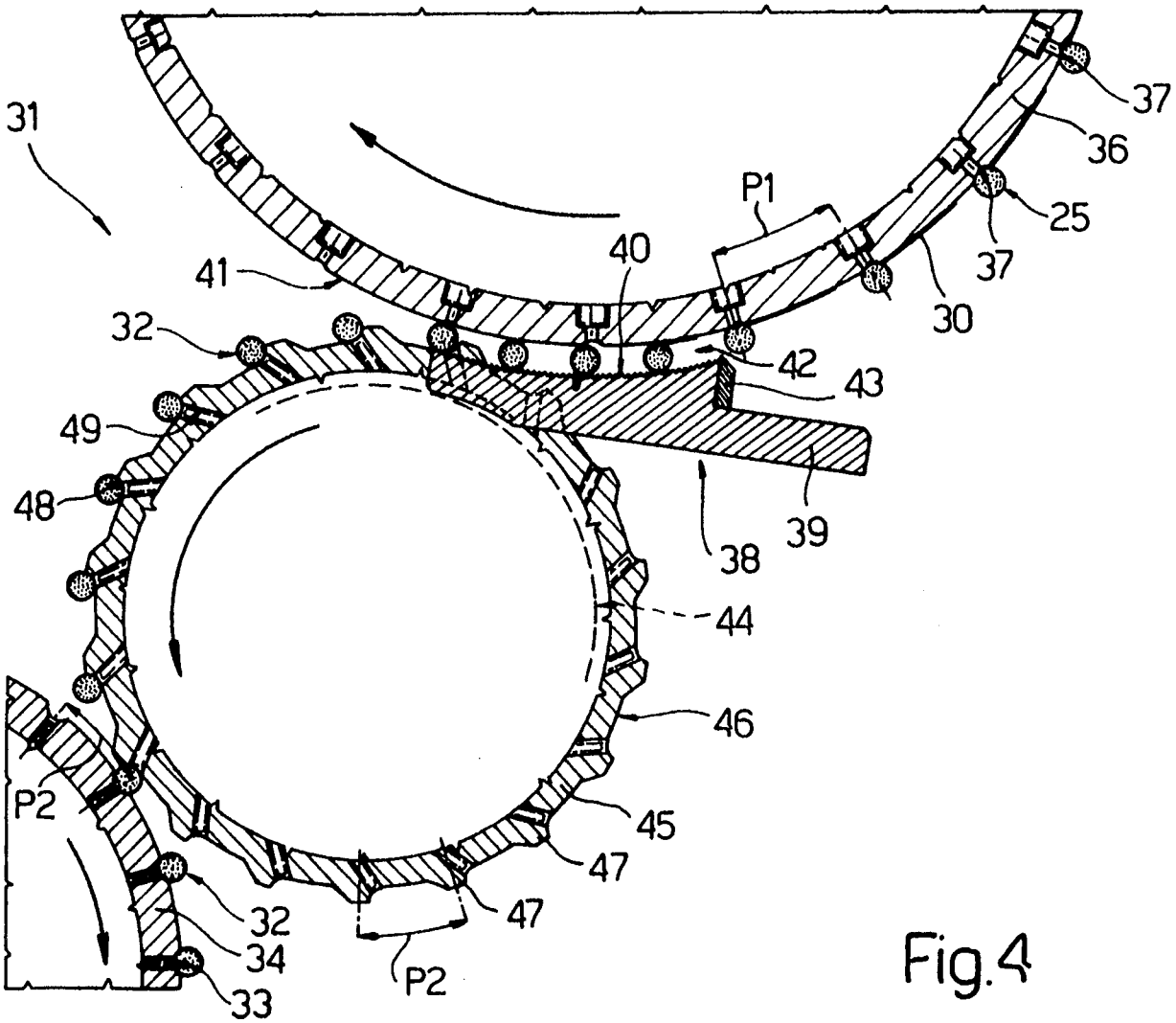
FIG. 4 shows a larger-scale section of a detail in FIG. 1.

As shown in FIG. 4, rolling unit 31 comprises an input roller 36 having seats 37 equally spaced by said distance P1 about the periphery of roller 36, and each designed to receive in known manner from roller 26 a respective group 25 and respective band 30. Roller 36 feeds groups 25 and respective bands 30 to a rolling station 38 defined by a fixed plate 39 arranged facing the outer periphery of roller 36 and in turn defined, on the side facing roller 36, by a knurled cylindrical surface portion 40 coaxial with roller 36 and separated from the cylindrical outer surface 41 of roller 36 by a distance approximately equal to but no greater than the diameter of portion 13, 14.

Plate 39 extends along path B in the traveling direction of groups 25 by a length equal to at least twice the length of band 30 and substantially equal to twice distance P1, and is centered in relation to seats 37. Plate 39 presents a width approximately equal to but no smaller than the width of band 30, and defines, with surface 41, a rolling channel 42 inside which extends, by a relatively small distance, the inclined end of a tooth 43 at the channel 42 input end of plate 39.

The end portion of plate 39 at the output portion of channel 42 engages a central annular groove 44 on a spacing roller 45, which receives double cigarettes 32 from station 38, and feeds them successively on to roller 34 and into respective seats 33 equally spaced about the periphery of roller 34 by distance P2, which is smaller than P1 and, in the example shown, substantially equal to P1/2.

Groove 44 defines on roller 45 two identical, coaxial end portione, each defined by a cylindrical outer surface 46 having its axis parallel to that of surface 41, and separated from surface 41 at said output portion of channel 42 by a minimum distance substantially equal to the diameter of double cigarette 32. Surface 46 presents a number of axial ribs 47 equally spaced along surface 46 by said distance P2, which, in the example shown, is approximately equal to but no less than P1/2. Ribs 47 define a succession of seats 48, each designed to receive a respective double cigarette 32, and each communicating with a respective suction conduit 49 adjacent to the rear edge of respective rib 47 in the rotation direction of roller 45.

By enabling double cigarettes 32 to be withdrawn by roller 45 prior to leaving rolling channel 42, rolling unit 31 thus exploits the inevitable reduction in pitch effected during the rolling operation, to achieve a pitch reduction from P1 to P2.

Rolling unit 31 may of course be replaced by any other type of rolling unit capable of rolling and simultaneously reducing the pitch of double cigarettes 32.

As shown in FIG. 2, in addition to roller 34, cutting unit 35 also comprises a rotary blade 50 substantially tangent to roller 34 and which provides for cutting respective double filters 18 of double cigarettes 32, to form two successions 51 and 52 of respect ire side by side, oppositely-oriented filter-tipped cigarettes 53*a* and 53*b*, i.e. arranged with their filters 54 facing and substantially contacting each other.

Successions 51 and 52 are transferred from roller 34 to a turnover unit 55 comprising two side by side rollers 56 and 57, the first of which is located tangent to roller 34, and is substantially twice as long as roller 57. Roller 56 rotates counterclockwise in FIG. 1 about its axis, and presents a number of suction seats 58 equally spaced by said distance P2 about the outer periphery of roller 56, and each designed to receive and retain a respective pair of oppositely-oriented cigarettes 53*a* and 53*b* arranged facing and contacting each other.

On the succession 52 side, roller 57 is connected integrally and coaxially with roller 56 by a connecting shaft 59 of given length, and presents a number of peripheral suction seats 60, each extending in line and coaxially with a corresponding seat 58, and each designed to receive and retain a respective filter-tipped cigarette 53*a* in a position parallel to and coaxial with a corresponding cigarette 53*b* inside corresponding seat 58. As they travel about roller 56, cigarettes 53*a* in succession 51 are transferred to a turnover unit 61 comprising two conical rollers 62, 63 and forming part of unit 55, and are transferred and simultaneously turned over 180° into said seats 60 on roller 57. Each cigarette 53*a* in succession 51 housed inside a respective seat 58 is thus turned over on to the opposite side of succession 52 and positioned in line with and facing the same way as corresponding cigarette 53*b*.

At the output of unit 55, successions 51, 52 are transferred from rollers 56, 57 to respective side by side, integral rollers 64 separated by a distance equal to the length of shaft 59. Rollers 64 are respectively tangent to rollers 56, 57, and constitute the input rollers of respective lines 65, 66 for feeding respective successions 52, 51 to respective known input devices 67, 68 of respective lines 69, 70 for conveying two masses 71, 72 of cigarettes 53*b*, 53*a* formed by grouping respective cigarettes 53*b* and 53*a* and arranging them in layers contacting one another.

Each line 65, 66 comprises two tangent conveyor rollers 73, 74, the first of which is also tangent to a respective roller 64; and a known test unit 75 in turn comprising a roller 76 tangent to respective roller 74 and by which respective cigarettes 53 are fed to known test devices 77. Devices 77 provide for successively testing cigarettes 53 as to permeability and/or imperfections and/or ventilation, and, if necessary, for rejecting them at a known reject station (not shown) on the periphery of a roller 78 tangent to roller 76 and located between roller 76 and an output roller 79 cooperating with respective input device 67, 68.

At the output of devices 67, 68, masses 71, 72 of cigarettes 53*b*, 53*a* are fed to respective transversely-spaced inputs (not shown) of a two-input packing machine 80, or to the inputs of a pair of single-input packing machines (not shown).

According to the variation shown in FIG. 5, both masses 71, 72 are combined and fed to a single input 81 of packing machine 82. For which purpose, provision is made, downstream from devices 67, 68 in the traveling direction of cigarettes 53, for a conveyor unit 83 for combining masses 71, 72 of cigarettes 53 into one mass of equioriented cigarettes 53. Conveyor unit 83 comprises two conveyor belts 85, 86 defining respective channels 87, 88 for feeding and guiding respective masses 71, 72. Channels 87, 88 present respective inputs 89, 90 communicating with the outputs of devices 67, 68; and respective adjacent, superimposed outputs 91, 92 communicating with the input of a channel 93 defined by a further conveyor belt 94 for feeding mass 84 of cigarettes 53 to input 81 of packing machine 82.

Operation of system A is substantially covered in the foregoing description, and therefore requires no further explanation. It should be pointed out, however, that, by exploiting the pitch reduction effected automatically in the course of rolling double cigarettes 32, and by maintaining the reduced pitch P2 over the entire portion of path B extending downstream from rolling station 38, it is possible, with no further reduction in pitch and with no need for complex pitch-reducing turnover devices, to achieve two successions 51, 52 of cigarettes 53*a*, 53*b*, the spacing of which is sufficiently reduced to avoid trouble when grouping the cigarettes into masses 71 and 72.

We claim:

1. A method for producing and delivering filter-tipped cigarettes, into two successions of cigarettes with only one pitch change occurring from a feeding stage through a rolling stage through cutting stage, and through a turnover stage, the method comprising:

in a feeding stage, feeding an orderly succession of first tobacco items along a given path substantially equally spaced at a first pitch, P1, each first item comprising two cigarette portions and an intermediate double filter, and feeding an outer band to each first item;

in a rolling stage, connecting, along said path, the two cigarette portions, the intermediate double filter and the outer band, to form an orderly succession of second items substantially equally spaced at a second pitch, P2;

maintaining an orderly succession of said second items at said second pitch, P2 during delivery of said second items to a cutting stage;

in a cutting stage located along said path, cutting the second items and forming a first and second succession of third items consisting of single, side by side, oppositely-oriented filter-tipped cigarettes maintained at said second pitch P2;

maintaining an orderly first and second succession of third items at said second pitch, P2 during delivery of said third items to a turnover stage; and in a turnover stage along said path, turning over by 180° the cigarettes in one of the two successions in relation to those in the other succession to equiorient the cigarettes in the two successions maintained at the second pitch, P2, and to form at least one stream of equioriented cigarettes for supply to a follow-up machine and wherein said pitch of said tobacco items has been changed only once as said items have been produced and delivered between said feeding stage and said follow-up machine.

2. The method as claimed in claim 1, wherein, in the course of said rolling stage, each said second item is fed along a rolling channel; the single change in pitch being imparted to each said second item along said rolling channel.

3. The method as claimed in claim 1, wherein, in the turnover stage, transferring each cigarette in the first succession from a first position in relation to the cigarettes in the second succession to a second position on the opposite side of the cigarettes in the second succession; said transfer resulting in the formation of two successions of equioriented, transversely-spaced cigarettes, wherein the cigarettes retain the same spacing as those in the first and second successions.

4. The method as claimed in claim 3, including the step of grouping the cigarettes in each succession into respective bulk streams of equioriented cigarettes.

5. The method as claimed in claim 4, including the step of feeding said two bulk streams of equioriented cigarettes to respective transversely-spaced inputs of a follow-up machine.

6. The method as claimed in claim 4, including the step of feeding said two bulk streams of equioriented cigarettes so they flow into each other and so form a single main bulk stream of cigarettes.

7. The method as claimed in claim 6, including the step of feeding one of said bulk streams over the other.

8. A method of producing and delivering filter-tipped cigarettes into two successions of cigarettes with only one pitch reduction occurring from a feeding stage through a rolling stage through a cutting stage, and through a turnover stage, the method comprising:

in a first and a second feeding stage, feeding tobacco items along respective consecutive first and second portions of a given path, the tobacco items being fed in orderly successions along said first path portion, and as at least one bulk stream along said second path portion; and in said first feeding stage, including the steps of advancing an orderly succession of first tobacco items including two cigarette portions and an intermediate double filter, and connecting the two cigarette portions and the intermediate double filter by means of a rolling stage and an outerband, to form an orderly succession of second tobacco items;

successively feeding the second tobacco items from the rolling stage to a cutting station without reducing the pitch of said second tobacco items;

cutting the second tobacco items at the cutting station to form a first and second orderly succession of third tobacco items consisting of single, side by side, oppositely-oriented filter-tipped cigarettes;

advancing the third tobacco items substantially without pitch reductions;

turning the third items in one of the two successions over by 180° in relation to those in the other succession to form two orderly successions of equioriented third tobacco items substantially without pitch reductions; and feeding the equioriented third tobacco items to said second path portion;

said first feeding stage including the step of reducing the pitch of said tobacco items in said first path portion, and thereupon transporting the tobacco items at the reduced pitch, and said pitch reducing being carried out in a single pitch reducing step.

9. The method as claimed in claim 8, wherein, in the course of said rolling stage, each said second item is fed along a rolling channel; said single pitch reducing step being imparted to each said second item along said rolling channel.

10. The method as claimed in claim 8, wherein said turnover sage provides for transferring each third tobacco item in the relevant first succession from a first position in relation to the third tobacco items in the relevant second succession to a second position on the opposite side of the third tobacco items in the second succession; said transfer resulting in the formation of two successions of equioriented, transversely-spaced third tobacco items, wherein the third tobacco items retain the same spacing as those in the first and second successions.

11. The method as claimed in claim 10, wherein said second feeding stage includes the step of grouping the third tobacco items into respective bulk streams of equioriented third items.

12. The method as claimed in claim 11, wherein the second feeding stage includes a further stage wherein said two bulk streams of equioriented cigarettes are fed to respective transversely-spaced inputs of a follow-up machine.

13. A method as claimed in claim 11, wherein the second feeding stage includes a further stage wherein said two bulk streams of equioriented cigarettes are made to flow into each other and so form a single main bulk stream of cigarettes.

14. A method as claimed in claim 13, wherein said two bulk streams of cigarettes are made to flow into each other by feeding one of said bulk streams over the other.

15. Apparatus for producing and delivering filter-tipped cigarettes, into two successions of cigarettes with only one pitch change occurring from a feeding stage through a rolling stage through a cutting stage, and through a turnover stage, said apparatus comprising:

a feeding stage, including means for feeding an orderly succession of first tobacco items along a given path substantially equally spaced at a first pitch, P1, each first item comprising two cigarette portions and an intermediate double filter, and feeding an outer band to each first item;

a rolling stage, including means for connecting, along said path, the two cigarette portions, the intermediate double filter and the outer band, to form an orderly succession of second items substantially equally spaced at a second pitch, P2;

means for transporting said second items from said rolling stage and maintaining an orderly succession of second items at said second pitch, P2;

a cutting stage located along said path for receiving said second items, including means for cutting the second items and forming a first and second succession of third items consisting of single, side by side, oppositely-oriented filter-tipped cigarettes maintained at said second pitch, P2;

means for transporting said third items and maintaining an orderly first and second succession of third items at said second pitch, P2; and a turnover stage along said path for receiving said third items, including means for turning over by 180° the cigarettes in one of the two successions in relation to those in the other succession to equiorient the cigarettes in the two successions maintained at the second pitch, P2, and to form at least one stream of equioriented cigarettes for supply to a follow-up machine and wherein said pitch of said tobacco items has been changed only once as said items have been produced and delivered between said feeding stage and said follow-up machine.

16. Apparatus as claimed in claim 15, wherein said rolling stage includes a rolling channel, each said second item is fed along said rolling channel and the single change in pitch being imparted to each said second item along said rolling channel.

17. Apparatus as claimed in claim 15, wherein said turnover stage includes transfer means for transferring each cigarette in the first succession from a first position in relation to the cigarettes in the second succession to a second position on the opposite side of the cigarettes in the second succession, said transfer resulting in the formation of two successions of equioriented, transversely-spaced cigarettes, wherein the cigarettes retain the same spacing as those in the first and second successions.

18. Apparatus as claimed in claim 17, wherein said transfer means includes a pair of conical rollers.

* * * * *